US006295745B1

(12) United States Patent
Bauvois

(10) Patent No.: US 6,295,745 B1
(45) Date of Patent: Oct. 2, 2001

(54) SKI BOOT

(75) Inventor: Jean Bauvois, Villard de Lans (FR)

(73) Assignee: Lange International S.A., Fribourg (CH)

( * ) Notice: Subject to any disclaimer, the term of this patent is extended or adjusted under 35 U.S.C. 154(b) by 0 days.

(21) Appl. No.: 09/332,696

(22) Filed: Jun. 14, 1999

(30) Foreign Application Priority Data

Jul. 3, 1998 (CH) ..... 1435/98

(51) Int. Cl.[7] ..... A43B 5/00
(52) U.S. Cl. ..... 36/118.2; 36/118.7
(58) Field of Search ..... 36/117.1, 118.2, 36/118.3, 118.7, 118.8

(56) References Cited

U.S. PATENT DOCUMENTS

| | | | | |
|---|---|---|---|---|
| 4,406,073 | | 9/1983 | Spademan . | |
| 4,447,970 | * | 5/1984 | Delery | 36/118.7 |
| 4,519,150 | * | 5/1985 | Arieh et al. | 36/118.7 |
| 4,761,899 | * | 8/1988 | Marxer | 36/118.7 |
| 5,033,210 | | 7/1991 | Dodge et al. . | |
| 5,065,533 | * | 11/1991 | Paris | 36/118.1 |
| 5,107,608 | | 4/1992 | Kreitenberg . | |
| 5,283,964 | * | 2/1994 | Chemellp | 36/118.7 |
| 5,446,976 | | 9/1995 | Donnadieu et al. . | |
| 5,901,470 | * | 5/1999 | Begey | 36/118.7 |

FOREIGN PATENT DOCUMENTS

| | | |
|---|---|---|
| 0379836 | 8/1990 | (EP) . |
| 0596281A | 5/1994 | (EP) . |
| WO 97/22271 | 7/1997 | (WO) . |

OTHER PUBLICATIONS

International Search Report in SN 1435/98—Switzerland.

* cited by examiner

*Primary Examiner*—M. D. Patterson
(74) *Attorney, Agent, or Firm*—Bugnion S.A.; John Moetteli

(57) ABSTRACT

The present invention relates to a ski boot comprising a first component, consisting essentially of a sole and an upper which encloses the foot and the malleolar region, and a second component consisting of a cuff which is articulated with respect to the upper so as to allow the cuff to move from front to rear and vice versa, and means for retaining the cuff which counteract the rearward tilting of the cuff but give way when the force tending to tilt the cuff exceeds a specific value. The retaining means are bistable. They consist of a stop (11) integral with one component of the boot and an elastically deformable part (6), for example a convex leaf, which is integral with the other component of the boot and is intended to be deformed by the stop.

10 Claims, 2 Drawing Sheets

SKI BOOT

BACKGROUND OF THE INVENTION

The present invention relates to a ski boot comprising a first component, consisting essentially of a sole and an upper which encloses the foot and the malleolar region, and a second component consisting of a cuff which is articulated with respect to the upper so as to allow the cuff to move from front to rear and vice versa, and means for retaining the cuff which counteracts the rearward tilting of the cuff but gives way when the force tending to tilt the cuff exceeds a specific value.

The purpose of such a design is to protect the skier's knee, and more precisely the anterior cruciate ligament, when an excessive forward force is exerted on the tibia relative to the femur. It has been observed that tears of the anterior cruciate ligament due to an excessive force of this type have become much more widespread while other types of injury, in particular broken legs and ankles have become much less frequent because of the progress made with safety bindings. Excessive force on the anterior cruciate ligament occurs, in particular, when going over a bump, either when jumping, on landing, or when going down the bump again quickly.

U.S. Pat. No. 5,107,608, the content of which is incorporated by reference, has already disclosed a boot equipped with a releasable retaining device intended to protect the anterior cruciate ligament in case of excessive force. This device comprises a latch in the form of a bent lever of the first class which is retained by a spring. In case of excessive force on the cuff, the spring will no longer be capable of retaining the latch, which will tilt and free the cuff. Such a device has the drawback that the skier cannot put it back into its initial position. It is also relatively bulky.

International Application WO 97/22 271, the content of which is incorporated by reference, moreover discloses a ski boot which is also equipped with a retaining device which releases in case of excessive force on the cuff, rearward. This device consists of a sprung linkage, the articulation of which has enough play to allow the articulation pin some degree of longitudinal movement in the lower element of the linkage, and the elements of which abut, at a point lying some distance from the articulation pin, at the end of a travel smaller than the possible displacement of the pin. Once the elements of the linkage have come to abut and the spring of the linkage has already undergone some degree of compression, if the force on the cuff continues to increase then the elements of the linkage will pivot about their bearing point and the linkage will release if its articulation moves beyond alignment of the points of articulation of the linkage to the upper and to the cuff. This device has the advantage that the skier can put it back into its initial position, but it is relatively complex and bulky.

SUMMARY OF THE INVENTION

The present invention proposes to produce the means for retaining the cuff much more simply and much less expensively than the devices according to the prior art.

The boot according to the invention is one wherein the retaining means are bistable elastic means consisting of a stop (11; 13; 21) integral with one component of the boot and an elastically deformable part (6; 4; 23) which is integral with the other component of the boot and is intended to be deformed by said stop.

The elastic part advantageously consists of a simple convex flexible leaf fitted by its ends into one of the components of the boot, preferably the cuff, so as to form a bistable part. The stop may be molded integrally with the other portion.

The design of the retaining means may be simplified further by doing without an extra elastic part. The elastically deformable part will consist of the cuff itself, in which an oblong cutout is formed which is oriented substantially vertically and has two components which have dimensions at least equal to the dimensions of said stud and are joined together by a narrowed section whose width is at least less than the horizontal dimension of the stud, so that it obstructs the stud. In this case, the elasticity of the plastic forming the cuff is therefore used.

BRIEF DESCRIPTION OF THE DRAWING(S)

The appended drawing represents three embodiments of the invention by way of example.

DETAILED DESCRIPTION OF THE PREFERRED EMBODIMENT(S)

Figure 2:
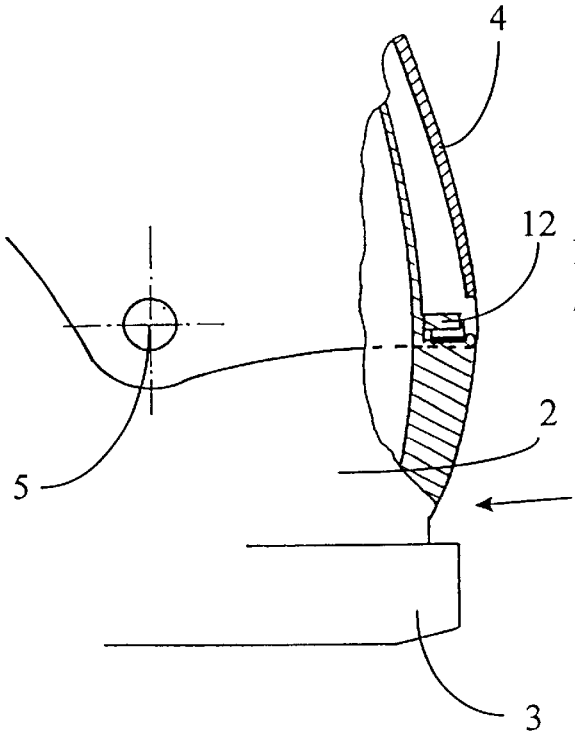
FIG. 2 is a partial, side view of the same embodiment, in which a cutaway allows the bistable device to be seen.
Figure 1:
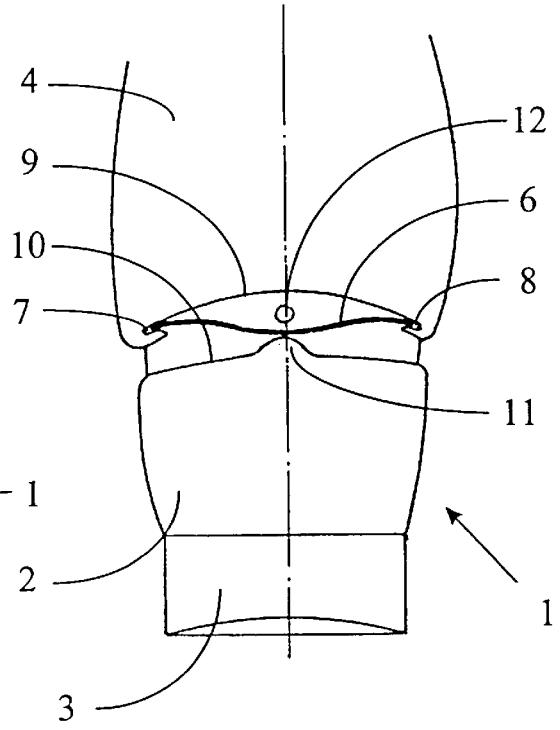
FIG. 1 is a partial back view of the first embodiment before release.
Figure 3:
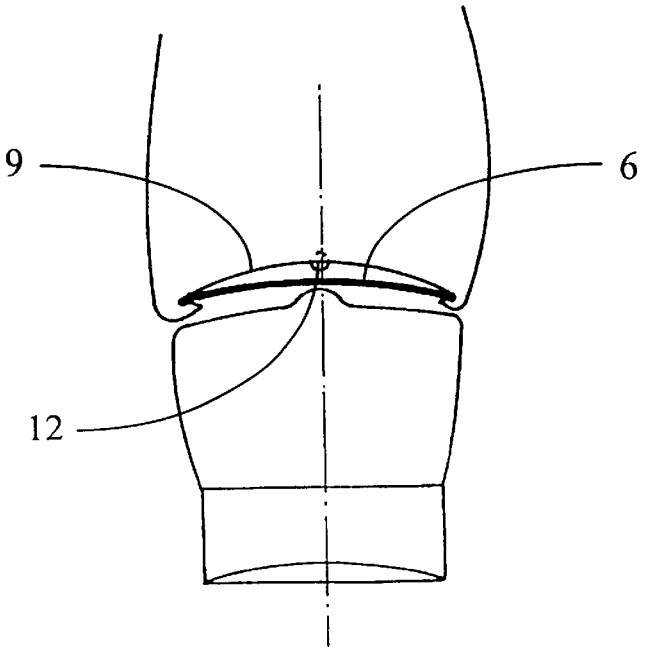
FIG. 3 is a similar view to FIG. 1 showing the bistable device after release.

The ski boot partially represented in FIGS. 1 to 3 essentially comprises a shell 1, forming an upper 2 enclosing the foot and the ankle level with the malleoli and a sole 3, and a lower-leg cuff 4 articulated to the shell 1 level with the malleoli at two opposite points 5. The cuff 4 is retained against rear tilting by a flexible leaf 6, for example made of steel, which is convex downward and is retained by its ends in two accommodating sections 7 and 8 of the cuff 4 which has a concave cutout 9 at the rear extending over the leaf 6. Below the leaf 6, the upper 2 has a supporting surface 10 in the middle of which a stop is formed in the shape of a boss 11 which comes into contact with the middle of the leaf 6. The retaining means are in a first stable state.

When a torque is applied to the cuff 4 forcing it to tilt rearward, the boss 6 exerts a flexural force on the leaf 6 whose ends become braced against the bottom of the accommodating sections 7 and 8, thus presenting resistance to the flexing of the leaf. When the force on the cuff exceeds a specific value, the leaf 6 deforms until it flips into its second stable state, represented in FIG. 3, in which state it assumes an upwardly convex position in the recess 9. Thus, the retainer means is bistable.

The upper 2 is provided with a tab 12 which projects over the leaf 6. This tab 12 makes it possible to bring the leaf 6 into its first stable state, FIG. 1, simply by flexing the leg: in the position represented in FIG. 3, the leaf 6 comes to abut against the tab 12 during this flexing.

This embodiment also has the advantage of matching the release threshold to the user's morphology through a suitable choice of the leaf 6.

In the second embodiment, the back of the upper 2 is provided with a stud 13 of oval shape, and the cuff has a cutout 14 of oblong shape which the stud 13 is engaged in. The cutout 14 is oriented substantially vertically and has two components 15 and 16 with dimensions such that the stud 13 can be accommodated therein in all its angular positions with little play. These two components 15 and 16 are joined by a narrowed section 17 with a width smaller than the largest transverse dimension of the stud 13. The stud 13 is provided with a screw slot 18 allowing it to be turned using a coin.

In the skiing position, the stud 13 is engaged in the lower component 15 of the cutout 14. It occupies the angular position represented in the drawing.

So long as the rearward tilting force on the cuff does not exceed the specific safety value, the cuff 4 is held in position by the stud 13, which comes to abut against the narrowed section 17. If this force exceeds the specific value, the stud 13 will clear the narrowed section 17 by elastically deforming the plastic material of the cuff 4. Release will take place. In order to return the cuff to the skiing position, all that needs to be done is to position the stud 13 in the walking position. This position is obtained by turning the stud 13 through 90°. In this position, the stud 13 can easily clear the narrowed section 15 and therefore allow the cuff to move relative to the upper.

The reverse kinematic mechanism would of course be possible, the stud being integral with the cuff and the upper having the elastically deformable narrowed section.

According to a variant (not shown), the stud 13 could have pairs of facets defining different stud widths. At least two pairs of facets will have distances, between the facets, greater than the width of the narrowed section 15. Depending on the orientation of the stud, the resistance to its passing through the narrowed section 17 will have higher or lower values.

Figure 5:
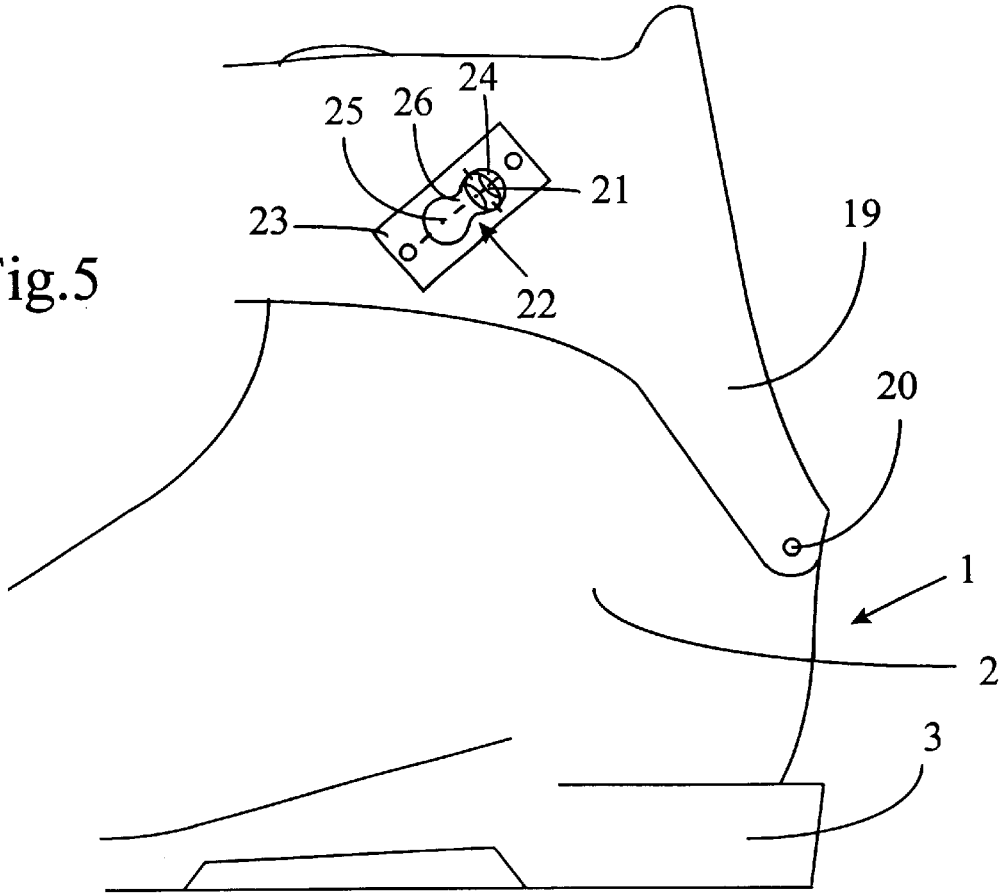
FIG. 5 is a side view of the third embodiment.

The principle of the second embodiment is also applicable to a boot whose cuff is rearwardly articulated to the rear of the shell. One illustrative embodiment is represented in FIG. 5. The boot is equipped with a lower-leg cuff 19 articulated at 20 to the rear of the upper 2. The cuff is retained against rearward tilting by a stud 21, similar to the stud 13, integral with the upper 2 on the side of this upper, and engaged in an oblong cutout 22 formed in a platelet 23, made of metal or plastic, fixed obliquely on the cuff 19. The cutout 22 has, in similar fashion to the cutout 14, two components 24 and 25 which have dimensions substantially equal to those of the stud 21 and are joined by a narrowed section 26 with a width smaller than the long dimension of the stud 21.

In the skiing position, the stud 21 is engaged in the component 24 of the cutout.

By providing platelets 23 with different rigidity, it is possible to match the release threshold to the user's morphology. A platelet may be changed according to the user's wishes.

Figure 4:
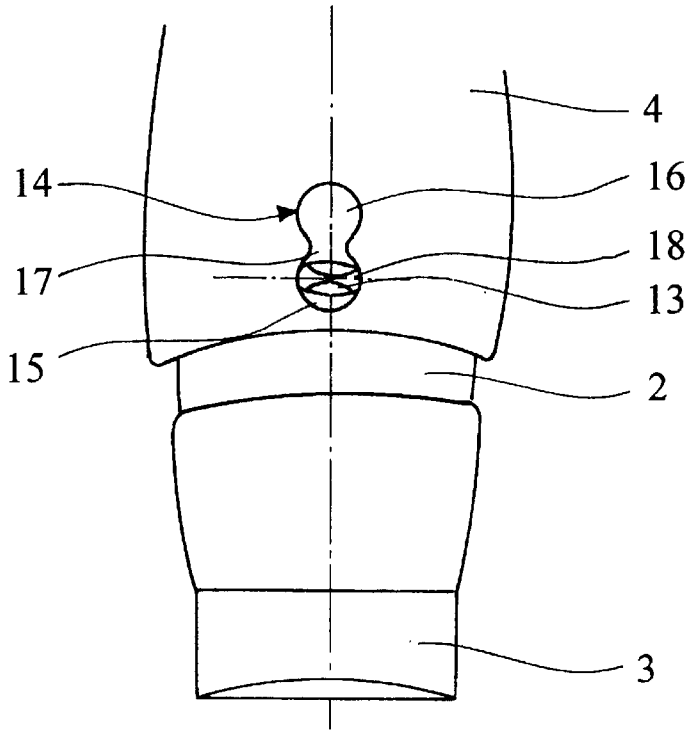
FIG. 4 is a back view of the second embodiment.

In the embodiment according to FIG. 4, the cutout 14 could also be formed in a platelet similar to the platelet 23. Conversely, in the embodiment according to FIG. 5, the cutout 22 could be formed in the plastic of the cuff.

Although illustrative embodiments of the invention have been shown and described, a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A ski boot comprising a first component (1), comprising of a sole (3) and an upper (2) which encloses the foot and the malleolar region, and a second component comprising of a lower-leg cuff (4; 19) which is articulated with respect to the upper so as to allow the cuff to move from front to rear and vice versa, and means for retaining the cuff which prevents the further rearward tilting of the cuff until a predetermined torque is reached, after which the retaining means gives way, permitting further movement of the cuff toward the rear, wherein the retaining means is a bistable elastic means consisting of a stop (11; 13; 21) integral with one component of the boot and an elastically deformable part (6; 4; 23) which is integral with the other component of the boot and which is deformed by said stop when the cuff moves between two stable positions.

2. The ski boot as claimed in claim 1, wherein the elastically deformable part is a convex flexible leaf (6) fitted by its ends into one of the components of the boot, so as to have two stable positions.

3. The ski boot as claimed in claim 1, wherein the stop comprises a stud (13) integral with the upper, and wherein the bistable part comprises the cuff itself (4) in which an oblong cutout (14) in which said stud is engaged is formed, this cutout being oriented substantially perpendicular to a radius passing through the articulation axis of the cuff and having two components (14, 15) which have dimensions at least equal to the dimensions of said stud and are joined together by a narrowed section (15) whose width is at least less than the largest transverse dimension of the stud, so that this narrowed section obstructs the stud, the stud being taken through the narrowed section by deformation of the cuff.

4. The ski boot as claimed in claim 3, wherein the stud (13; 21) has at least two pairs of pairwise parallel facets in which the distances are different for each pair, these distances being greater than the width of the narrowed section (17; 26).

5. The ski boot as claimed in claim 4, wherein said stud (13; 21) has a transverse dimension smaller than the width of said narrowed section (17; 26).

6. The ski boot as claimed in claim 3, wherein said stud (13; 21) has a transverse dimension smaller than the width of said narrowed section (17; 26).

7. The ski boot as claimed in claim 1, wherein the stop comprises a stud (21 ) integral with the upper, and wherein the bistable part comprises an added part (23) which is fixed on the cuff and has an oblong cutout (22) in which said stud (21) is engaged, this cutout being oriented substantially perpendicular to a radius passing through the articulation axis of the cuff and having two components (24, 25) which have dimensions at least equal to the dimensions of said stud (21) and are joined together by a narrowed section (26) whose width is at least less than the largest transverse dimension of the stud, so that this narrowed section obstructs the stud, the stud being taken through the narrowed section by deformation of the added part (23).

8. The ski boot as claimed in claim 4, wherein the stud (13; 21) has at least two pairs of pairwise parallel facets in which the distances are different for each pair, these distances being greater than the width of the narrowed section (17; 26).

9. The ski boot as claimed in claim 4, wherein said stud (13; 21) has a transverse dimension smaller than the width of said narrowed section (17; 26).

10. The boot as claimed in claim 4, wherein the added part having means for permitting interchangeability.

* * * * *